United States Patent [19]

Murphy

[11] Patent Number: 4,800,698

[45] Date of Patent: Jan. 31, 1989

[54] CLIP FOR JOINING SHEET METAL BEAM MEMBERS

[76] Inventor: Wesley T. Murphy, 94 Prospect St., Auburn, N.Y. 13021

[21] Appl. No.: 131,133

[22] Filed: Dec. 10, 1987

[51] Int. Cl.[4] ..... E04B 1/38

[52] U.S. Cl. ..... 52/714; 52/712; 403/397; 403/389; 403/400

[58] Field of Search ..... 52/699, 712, 713, 714, 52/489, 484; 403/397, 389, 400

[56] References Cited

U.S. PATENT DOCUMENTS

| | | | |
|---|---|---|---|
| 2,109,213 | 2/1938 | Fearing | 403/397 |
| 2,910,155 | 10/1956 | Bradner | 52/714 |
| 3,044,583 | 7/1962 | Klotz | 52/489 |
| 3,232,018 | 2/1966 | MacKean | 52/714 |
| 3,300,924 | 1/1967 | Ashby et al. | 52/489 |
| 3,511,011 | 5/1970 | Straus | 52/489 |
| 3,753,325 | 8/1973 | Stanley et al. | 52/489 |
| 3,806,994 | 4/1974 | Lankford | 403/397 |
| 3,962,840 | 6/1976 | Nelsson | 52/714 |
| 4,069,636 | 1/1978 | Kessler | 52/712 |
| 4,192,119 | 3/1980 | Murphy | 52/731 |
| 4,201,026 | 5/1980 | Murphy | 52/531 |
| 4,358,216 | 11/1982 | Pleickhardt et al. | 403/397 |
| 4,425,747 | 1/1984 | Player | 52/714 |
| 4,596,094 | 6/1986 | Teller et al. | 52/489 |

FOREIGN PATENT DOCUMENTS

| | | | |
|---|---|---|---|
| 1034732 | 7/1978 | Canada | 52/489 |

*Primary Examiner*—David A. Scherbel
*Assistant Examiner*—Caroline D. Dennison
*Attorney, Agent, or Firm*—Wall and Roehrig

[57] ABSTRACT

A clip for joining sheet metal beams to one another is formed of a single strip of sheet steel. An arcuate spring plate fits between the flanges of one beam, with a free edge engaging beneath a lip, and a transverse bend at the other edge of the arcuate section joined to a member that extends downward outside the other flange and beneath the web of the one beam. At a second bend there is a flange that rises to engage one of the flanges of the second beam beneath a bent-in lip thereof. The clips can be constructed for joining parallel beams, beams that cross at right angles, or beams that cross at any arbitrary angle.

9 Claims, 2 Drawing Sheets

CLIP FOR JOINING SHEET METAL BEAM MEMBERS

BACKGROUND OF THE INVENTION

This invention relates to sheet metal building construction and is more especially directed to fasteners for joining sheet metal beam members, such as purlins, joists, wall studs, or the like.

Currently, the fabrication of sheet metal structures requires specialized tools and considerable skill in building construction. Because of the global need for low-cost, simple to construct housing which the end user could construct on a self-help basis, there has long been a need for simple and durable building construction systems which can be assembled by persons without much skill in the building trades and without requiring special tools. In particular, there is a need for fasteners that can be used to join sheet metals beams that run parallel or cross, and which avoid problems that are associated with bolts, rivets, or other conventional fastening means.

The sheet metal construction beams with which such a fastener might be used are described in my earlier U.S. Pat. Nos. 4,188,147 granted Jan. 12, 1980; 4,192,119, granted Mar. 11, 1980 and 4,201,026, granted May 6, 1980, and also in my copending U.S. patent application Ser. No. 086,382 filed Aug. 14, 1987.

OBJECTS AND SUMMARY OF THE INVENTION

It is therefore an object of this invention to improve the system of structural members used in the construction of buildings and the like.

A further object of this invention is to provide a sheet metal clip type fastener capable of joining sheet metal beam members.

Another object is to simplify the technique and equipment for joining sheet metal structural members.

A more particular object is to provide a clip type fastener that simply snaps into place yet holds the sheet metal structural members quite securely.

In accordance with an aspect of the invention, a simple to use fastener for joining sheet metal beams to one another takes the form of a clip made of a strip of sheet steel. The beams each should have a box or channel type structure with a web that has a pair of flanges that rise from it, and with a bent-in lip at the free edge of one of the flanges. The clip has an arcuate, i.e., generally cylindrically-surfaced section to fit between the flanges of one of the beams, with one edge fitting beneath the lip of that beam. A transverse bend at the other edge of the arcuate section fits over the edge of the other flange of the one beam and has a section passing down outside the flange to fit beneath the web of the one beam. The flat portion extends within the other beam, and has an angled flange joined to it at a transverse bend, this flange being dimensioned to fit snugly beneath the bent in lip of said other beam. This flange may have a lip at its free edge. To accommodate joining of beams that cross at an angle, certain embodiments of the clip may have a diagonally bent plate adjoining the arcuate section at the first bend.

The clip should be stiff, but rather resilient to fit snugly by spring action in the two associated sheet metal beams.

The above and many other objects, features and advantages of this invention will be more fully understood from the ensuing description of a preferred embodiment when considered in connection with the accompanying drawing.

DETAILED DESCRIPTION OF THE PREFERRED EMBODIMENTS

Figure 1:
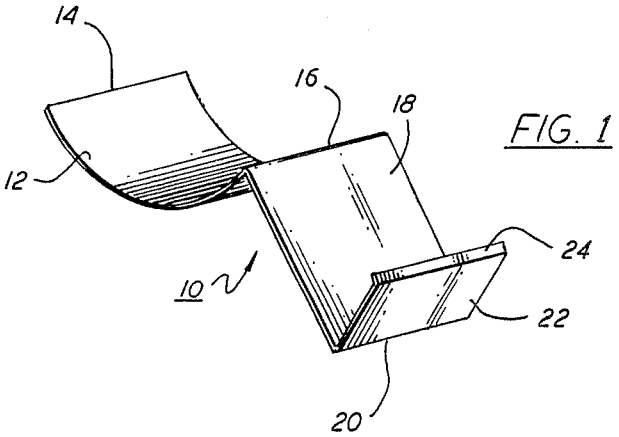
FIG. 1 is a perspective view of a sheet steel clip according to an embodiment of this invention.
Figure 2:
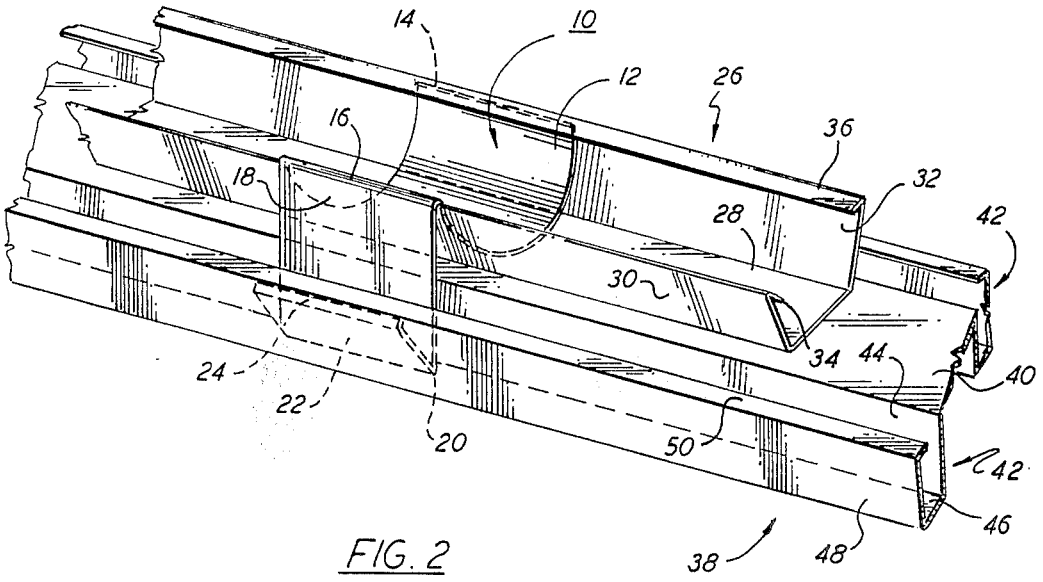
FIG. 2 is a perspective view of the clip of FIG. 1 joining a pair of parallel sheet metal beam members.

Referring to the drawing, and initially to FIG. 1, there is shown a clip 10 that embodies the teachings of the present invention. As shown, the clip 10 includes an arcuate plate 12 which extends from a free edge 14 to a transverse bend 16 at the other edge. The plate 12 is generally formed as a portion of a cylindrical surface. At the bend 16, a flat plate 18 extends outward to a second transverse bend 20, where there is joined a flange 22 that has a bent-in lip 24 at its free end. The clip 10 is used for joining together parallel sheet metal beam members, generally as shown in FIG. 2.

In the illustrated mode of employment, the clip 10 has the arcuate section 12 connected to a sheet metal purlin 26. This purlin has a horizontal planar web 28, and a pair of flanges 30 and 32, each of which has a bent-in lip 34,36, respectively. The plate 18, bend 20 and flange 22 of the clip connect to another sheet metal beam 38, here of the "Double-D" type, for example as illustrated in U.S. Pat. Nos. 4,192,119 and 4,201,026. This beam 38 has a flat central web 40, and a pair of box flange members 42, each formed of a depending flange 44, a planar web 46, an upstanding flange 48, and a lip 50 at the upper free edge of the flange 48. The sheet steel clip 10 is formed of a single strip of metal, and is rather stiff, but is resiliently deformable to fit firmly into the two associated beam members 26 and 38. The free edge 14 of the clip arcuate member 12 fits beneath the lip 36 of the purlin 26, and the first bend 16 carries the clip 10 over the edge of the other purlin flange 30. The flat plate 18 extends downward beneath the web 28 of the purlin into the box flange 42 of the Double-D beam 38, where the flange 22 and lip 24 are resiliently biased outwards against the flange 48 and lip 50 of the beam 38.

In this mode, a number of these clips 10 would be installed, alternately clipping or fastening the purlin 26 to the two box flange members 42 of the beam 38.

Figure 3:
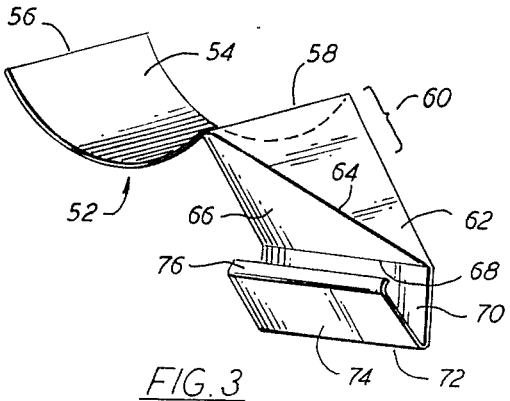
FIG. 3 is a perspective view of a sheet steel clip according to another embodiment of this invention.
Figure 4:
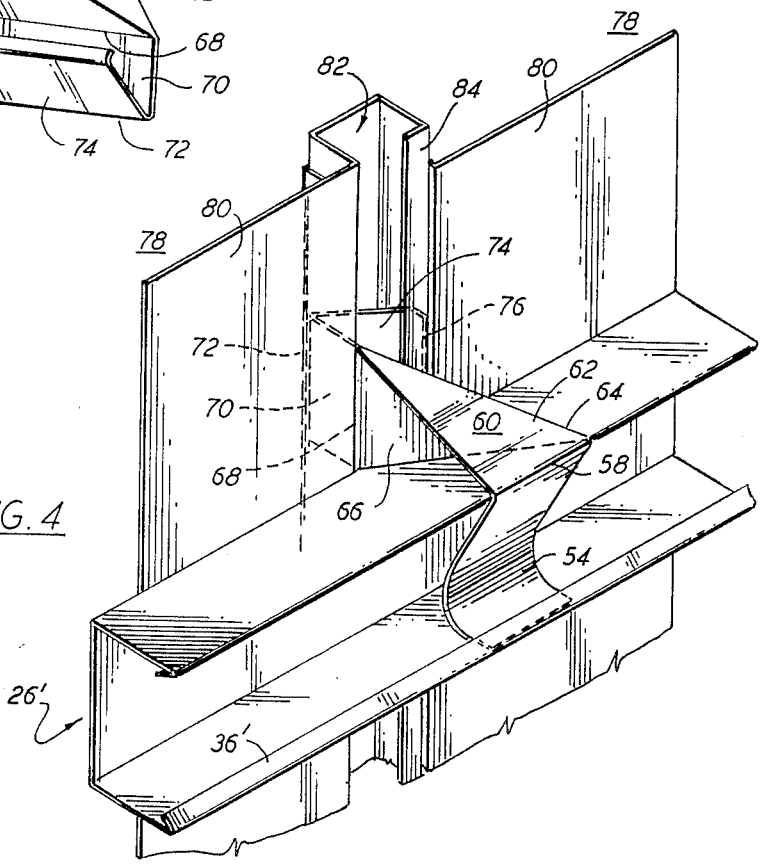
FIGS. 4 is a perspective view of the clip of FIG. 3 joining a pair of sheet metal beam members that cross at a right angle.
Figure 5:
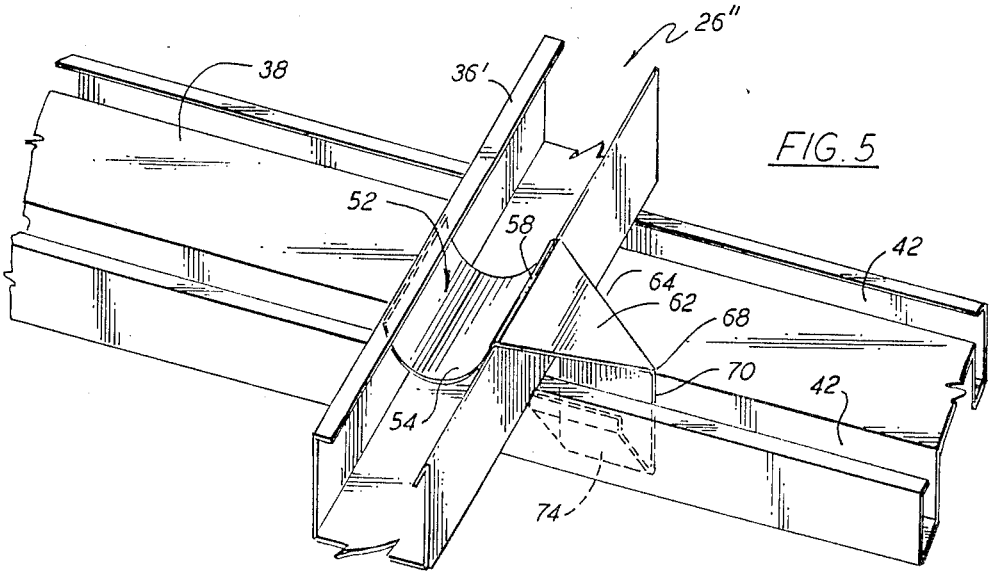
FIG. 5 is a perspective view of another clip that joins two crossing sheet metal beams.

A second embodiment of this invention is shown in Figs. 3–5, and a clip 52 for joining right-angle crossing beams is shown with initial reference to FIG. 3. This clip 52 has an arcuate spring plate 54 with a free end 56 and a first transverse bend 58 opposite it. A ridged angle plate 60 is connected at the bend 58, and is generally formed of a first triangular member 62, with a diagonal bend or ridge 64 joining the same to a second triangular member 66. A second bend 68 at the end of the angle plate 60 remote from the first bend 58 is at a predetermined angle, namely 90 degrees, with respect to the first bend 58. A flat plate 70 continues from the bend 68, to a third transverse bend 72, at which is joined a flange 74 having a lip 76 at its free edge. This clip is employed as generally shown in FIG. 4 to join a purlin member 26' to a structural beam member 78 that crosses at right angles to the purlin member 26'. Here, the purlin member has generally the same structure as that of FIG. 2, and its detailed description can be omitted. The other member comprises a wall plate or floor plate 80 formed as a structural unitary sheet metal member with an integral box or channel member 82 formed at the end thereof and having an inwardly projecting lip 84. As shown in FIG. 4, the clip 52 has the free end 56 of its arcuate plate 54 inserted beneath a flange lip 36' of the purlin member 26'. The ridged angle plate 60 extends generally downward along the outside of one flange of the purlin member 26' so that the flat plate 70 of the clip extends into the box member 82. The clip flange 74 and its lip 76 are biased against the beam lip 84 so that the plate 70, bend 72, and flange 74 form a hook member that locks into the box member 82 of the wall plate A complementary clip is shown in FIG. 5, that is, a clip in which the diagonal bend 64 of the angle plate 60 has a sense opposite to that shown in FIGS. 3 and 4, i.e., from the right side of the bend 58, rather than from the left side as in FIG. 3. The flange 74 can extend either outward or inward, depending on the desired orientation of the crossing sheet metal beam members. In FIG. 5, the clip is shown joining a purlin member 26'' to one box flange 42 of a Double-D sheet metal beam 38.

In the first embodiment, the clip is shown with the flange 22 extending at an acute angle outward from the side of the plane of the flat plate member 18 opposite that on which the arcuate section 12 is situated. However, in other embodiments, the flange 22 could be situated on the same side, i.e., beneath the arcuate section 12.

Although the invention has been described in detail with respect to certain preferred embodiments, it should be understood that the invention is not limited to these precise embodiments. Rather, many modifications and variations thereof would be apparent to those of skill in the art without departing from the scope and spirit of this invention as defined in the appended claims.

What is claimed is:

1. A sheet metal clip for joining a sheet metal beam to another sheet metal beam, each of said beams being formed of a planar web, a pair of flanges that rise from the web, and a bent-in lip at a free edge of at least one of the flanges, said clip comprising an arcuate spring plate fitting between the flanges of one said beam with a free edge engaging the lip of said one beam; a first transverse bend at the other edge of said arcuate spring plate; a flat plate joined to said first bend and extending outside the associated flange of said one beam beyond the plane of the web thereof; a second transverse bend at the edge of said plate remote from the first bend; and a flange rising from said second bend to engage one of the flanges of the second beam beneath the lip thereof.

2. The sheet metal clip of claim 1 in which the clip flange has a bent-in lip at a free edge thereof.

3. The sheet metal clip of claim 1 in which the second bend and flange are arranged on the side of the plane of the flat plate opposite the arcuate plate.

4. The sheet metal clip of claim 1 in which the clip is unitarily formed from a single strip of said sheet metal.

5. A sheet metal clip for joining a first sheet metal beam to a second sheet metal beam that crosses it at a predetermined angle, each of said beams being formed of a planar web, a pair of flanges that rise from the web, and a bent-in lip at a free edge of at least one of the flanges, said clip comprising an arcuate spring plate fitting between the flanges of the first beam with a free edge thereof engaging the lip of the first beam; a first transverse bend at the other edge of said arcuate spring plate; a diagonally bent plate member joined to said first bend and having a first triangular section joined by a diagonal ridge to a second triangular section, one edge of the first triangular section being joined to the first bend; a second bend at one edge of the second triangular section, the second bend having a bend line that is at said predetermined angle to the bend line of said first bend; a flat plate joined to the second triangular portion at said second bend and extending beyond the plane of the web of said first beam, a third transverse bend at an edge of said flat plate, and a flange rising from said third bend to engage one of the flanges of said second beam beneath the lip thereof.

6. The sheet metal clip of claim 5 in which the clip flange has a bent-in lip at a free edge thereof.

7. The sheet metal clip of claim 5 in which the clip is unitarily formed from a single strip of said sheet metal.

8. The sheet metal clip of claim 5 in which the predetermined angle is substantially 90 degrees.

9. The sheet metal clip of claim 5 in which said ridge extends diagonally from one end of the first transverse bend to an opposite edge of the second bend.

* * * * *